US009208970B2

(12) United States Patent
Chen et al.

(10) Patent No.: US 9,208,970 B2
(45) **Date of Patent: *Dec. 8, 2015**

(54) KEY ASSEMBLY FOR A HANDHELD ELECTRONIC DEVICE HAVING A ONE-PIECE KEYCAP

(71) Applicant: BlackBerry Limited, Waterloo (CA)

(72) Inventors: Chao Chen, Waterloo (CA); Dietmar Frank Wennemer, Waterloo (CA); Jana Lynn Papke, Waterloo (CA)

(73) Assignee: BlackBerry Limited, Waterloo (CA)

( * ) Notice: Subject to any disclaimer, the term of this patent is extended or adjusted under 35 U.S.C. 154(b) by 79 days.

This patent is subject to a terminal disclaimer.

(21) Appl. No.: 14/222,859

(22) Filed: Mar. 24, 2014

(65) Prior Publication Data

US 2014/0202839 A1 Jul. 24, 2014

Related U.S. Application Data

(63) Continuation of application No. 12/393,153, filed on Feb. 26, 2009, now Pat. No. 8,723,062.

(51) Int. Cl.
*H01H 9/26* (2006.01)
*H01H 13/704* (2006.01)
(Continued)

(52) U.S. Cl.
CPC ..... *H01H 13/704* (2013.01); *H01H 13/705* (2013.01); *H01H 13/83* (2013.01); *H01H 2209/01* (2013.01); *H01H 2219/056* (2013.01); *H01H 2219/064* (2013.01); *H01H 2221/044* (2013.01); *H01H 2233/002* (2013.01)

(58) Field of Classification Search
CPC ..... H01H 13/023; H01H 2219/062; H01H 2221/07; H01H 13/702; H01H 2219/018; H01H 13/14; H01H 13/705; H01H 2219/04
USPC ..... 200/5 A, 310, 315, 516
See application file for complete search history.

(56) References Cited

U.S. PATENT DOCUMENTS 4,170,104 A 10/1979 Yamagata
5,573,107 A 11/1996 Nakano et al.
(Continued)

FOREIGN PATENT DOCUMENTS

DE 196 46 513 5/1998
EP 0845795 6/1998
(Continued)

OTHER PUBLICATIONS

Extended European search report—EP App No. 09171439.4—Nov. 2, 2009.
(Continued)

*Primary Examiner* — Xuong Chung Trans
(74) *Attorney, Agent, or Firm* — Ridout & Maybee LLP

(57) ABSTRACT

A key assembly for an electronic device having a one-piece keycap and an electronic device having such a keycap are provided. In accordance with one embodiment, there is provided a key assembly for use in an electronic device, comprising: a keycap having a plurality of rigid key portions separated by mechanically deforming portions; and a flexible member having opposed first and second sides, the first side having a plurality of key stems which are attached to the plurality of key portions, the second side having a plurality of actuators for actuating dome switches of the electronic device.

20 Claims, 5 Drawing Sheets

(51) Int. Cl.
*H01H 13/705* (2006.01)
*H01H 13/83* (2006.01)

(56) References Cited

U.S. PATENT DOCUMENTS

| | | | | |
|---|---|---|---|---|
| 5,664,667 | A | 9/1997 | Kenmochi | |
| 5,711,588 | A | 1/1998 | Rudisill | |
| 5,734,136 | A | 3/1998 | Newcomer et al. | |
| 5,909,021 | A | 6/1999 | Duffy | |
| 6,180,895 | B1 * | 1/2001 | Hutchinson et al. | 200/5 A |
| 6,727,447 | B2 | 4/2004 | Hentunen | |
| 6,738,475 | B1 | 5/2004 | Lieber | |
| 6,876,149 | B2 | 4/2005 | Miyashita | |
| 6,997,527 | B2 | 2/2006 | Cheng | |
| 7,070,349 | B2 | 7/2006 | Dombrowski et al. | |
| 7,176,894 | B2 * | 2/2007 | Ostergård et al. | 345/168 |
| 7,345,250 | B2 * | 3/2008 | Hakunti et al. | 200/5 A |
| 7,360,957 | B2 | 4/2008 | Dombrowski et al. | |
| 7,579,561 | B2 | 8/2009 | Wee et al. | |
| 7,671,290 | B2 | 3/2010 | Chen et al. | |
| 7,690,803 | B2 | 4/2010 | Miyashita et al. | |
| 7,825,899 | B2 | 11/2010 | Chen | |
| 7,935,904 | B2 | 5/2011 | Song | |
| 8,183,478 | B2 * | 5/2012 | Lamers et al. | 200/5 A |
| 8,207,872 | B2 * | 6/2012 | Huang et al. | 341/22 |
| 8,723,062 | B2 | 5/2014 | Chen et al. | |
| 2005/0281605 | A1 | 12/2005 | Dombrowski et al. | |
| 2007/0039809 | A1 | 2/2007 | Aihara et al. | |
| 2008/0018499 | A1 | 1/2008 | Chang | |
| 2008/0031673 | A1 | 2/2008 | Chang et al. | |
| 2008/0037277 | A1 | 2/2008 | Yamaguchi et al. | |
| 2008/0094373 | A1 | 4/2008 | Song | |
| 2008/0197005 | A1 | 8/2008 | Bu et al. | |
| 2009/0122558 | A1 | 5/2009 | Tsai et al. | |

FOREIGN PATENT DOCUMENTS

| | | |
|---|---|---|
| EP | 1350826 | 10/2003 |
| EP | 1450385 | 8/2004 |
| EP | 1739934 | 1/2007 |
| EP | 1758139 | 2/2007 |
| EP | 2031619 | 12/2007 |
| EP | 1892737 | 2/2008 |
| EP | 1918953 | 5/2008 |
| GB | 2366761 | 1/2003 |
| JP | 11 126536 | 5/1999 |
| JP | 2009 021108 | 1/2009 |
| WO | WO 03017300 | 2/2003 |
| WO | WO 2007100180 | 9/2007 |
| WO | WO 2007142211 | 12/2007 |

OTHER PUBLICATIONS

LED Light Guide Plate: http://mxcnblm.en.alibaba.com/product/209666732-200223007/LED_Light_Guide_Plate.html, at least as early as Mar. 12, 2009.
Keypad Light Guide, http://xuncnblurLen.alibaba.com/product/207982581-200223007/keypad_light_guide_html.
MicroLens—Solutions for Keypad Backlighting, http://www.glthome.com/images/keypad0905.pdf, Mar. 11, 2006.
David DeAgazio, The MicroLens Concept: Backlighting with Fewer LEDs, 2006.
MicroLens Light Extraction, http://www.glthome.com/images/MicroLens-LightExtrct.PDF, Oct. 15, 2006.
Extended European Search Report—EP 11156716.0—Apr. 14, 2011.
Communication pursuant to article 94(3)—EP App No. 09153733.2—Oct. 1, 2010.
Extended European search report—EP App No. 09153733.2—Jun. 24, 2009.
Silitech—Multi-image keypad—liteon group—Sep. 18, 2008.
EECO—Elastomer series: silicone rubber keypads, Oct. 17, 2007.

* cited by examiner

KEY ASSEMBLY FOR A HANDHELD ELECTRONIC DEVICE HAVING A ONE-PIECE KEYCAP

TECHNICAL FIELD

The present disclosure relates generally to input devices, and more particularly to key assemblies for handheld electronic devices, and more particularly to a key assembly for a handheld electronic device having a one-piece keycap.

BACKGROUND

Keypad and keyboard designs in handheld electronic devices attempt to balance several design constraints which often include the ability to provide illuminated keys, a visual separation between keys, a tactile separation between keys, tactile feedback to device users in response to a key press, and providing such features within a relatively thin device profile.

Modern keypad and keyboard designs often utilize dome switches rather than mechanical "hard closing" switches to provide a thinner device profile. Dome switches provide "soft closing" switches compared to mechanical "hard closing" switches which, depending on the key assembly in which the switches are used, may result in poor tactile feedback to device users in response to a key press (often described as a soft or "spongy" key press). Depending on the keypad or keyboard design which is used, the use of dome switches may result in keys which are wobbly and unstable, and more prone to damage. In view of these and other deficiencies in keypad and keyboard designs, there remains a need for improved key assemblies for handheld electronic devices.

BRIEF DESCRIPTION OF THE DRAWINGS

Like reference numerals are used in the drawings to denote like elements and features.

DETAILED DESCRIPTION OF EXAMPLE EMBODIMENTS

Figure 1:
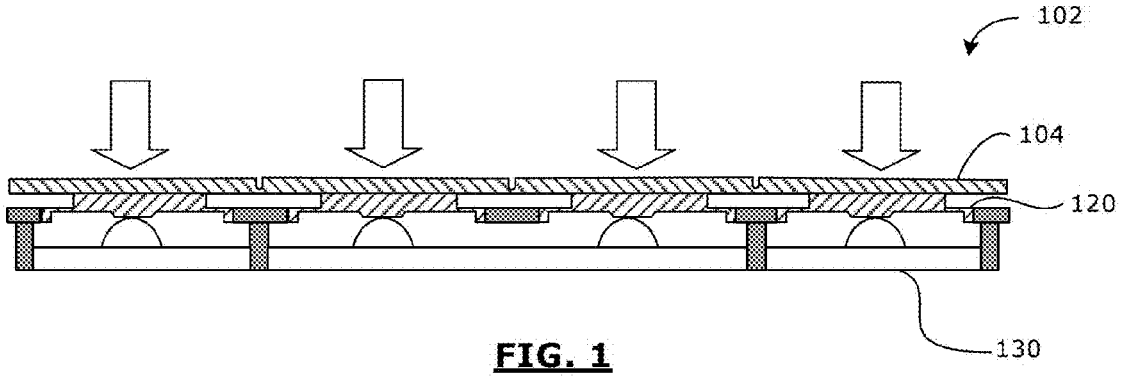
FIG. 1 is a sectional view of a key assembly in accordance with one example embodiment of the present disclosure.

The present disclosure provides a key assembly for a handheld electronic device (such as a mobile communications device) having a one-piece keycap. The keypad has mechanically deforming portions between key portions. The key assembly provides improved key stability, provides improved tactile feedback in response to key presses (i.e., firm key presses), and reduces the likelihood of damaging keys compared with at least some of the known key assemblies. In addition, in some embodiments the mechanically deforming portions may be provided using grooves formed in the one-piece keypad which, when provided on the externally facing side of the keycap, provides a visual separation between key portions of the keypad for key identification by device users.

In accordance with one embodiment of the present disclosure, there is provided a key assembly for use in an electronic device, comprising: a keycap having a plurality of rigid key portions separated by mechanically deforming portions; and a flexible member having opposed first and second sides, the first side having a plurality of key stems which are attached to the plurality of key portions, the second side having a plurality of actuators for actuating dome switches of the electronic device.

In accordance with another embodiment of the present disclosure, there is provided an electronic device, comprising: a controller for controlling the operation of the device; a dome sheet comprising a plurality of dome switches connected to the controller for generating an input signal in response to actuation thereof; and a key assembly comprising: a keycap having a plurality of rigid key portions separated by mechanically deforming portions; and a flexible member having opposed first and second sides, the first side having a plurality of key stems which are attached to the plurality of key portions, the second side having a plurality of actuators for actuating the dome switches; the controller being configured for receiving input signals in response to the actuation of the dome switches and for recognizing corresponding inputs in response to the received input signals. In at least some embodiments, a printed circuit board connects the dome switch sheet and the controller.

The teachings of the present disclosure relate generally to handheld electronic devices such as mobile (e.g., wireless) communication devices such as pagers, cellular phones, Global Positioning System (GPS) navigation devices and other satellite navigation devices, smartphones, wireless organizers and wireless personal digital assistants (PDA). The handheld electronic devices could be a device without wireless communication capabilities such as a PDA, electronic gaming device, digital photograph album or picture frame, digital camera, or digital video recorder such as a camcorder. The portable electronic device may comprise a touchscreen display as well as a keypad. These examples are intended to be non-limiting. It is also possible that the teachings of the present disclosure could be applied to electronic devices other than handheld electronic devices such as notebook computers.

Figure 2:
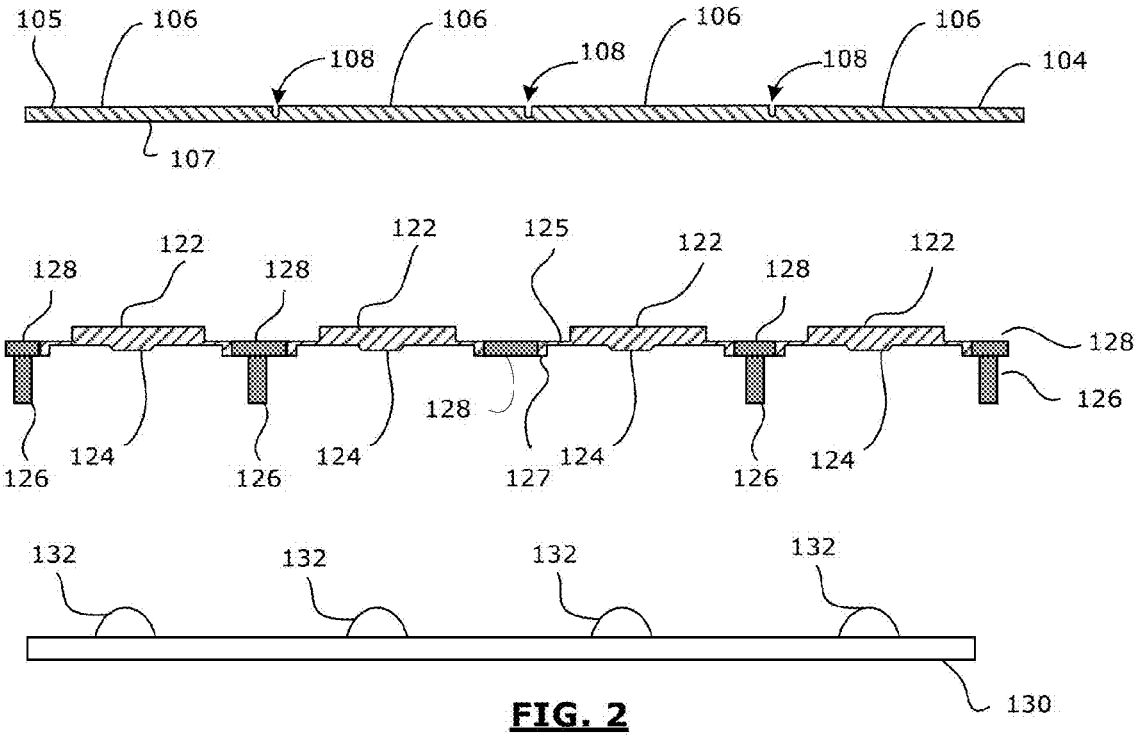
FIG. 2 is an exploded sectional view of the key assembly of FIG. 1.
Figure 3:
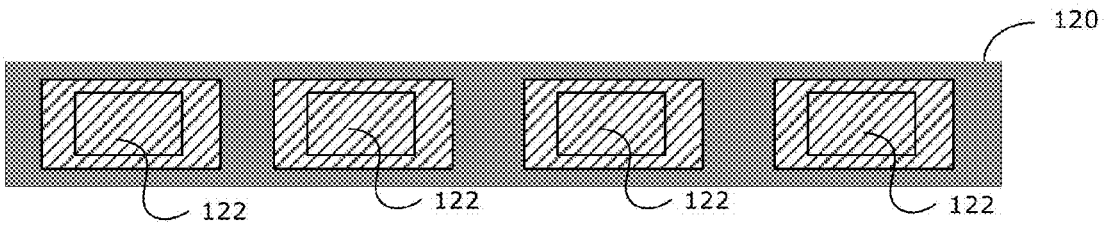
FIG. 3 is a top view of the key subassembly of FIG. 2.
Figure 9:
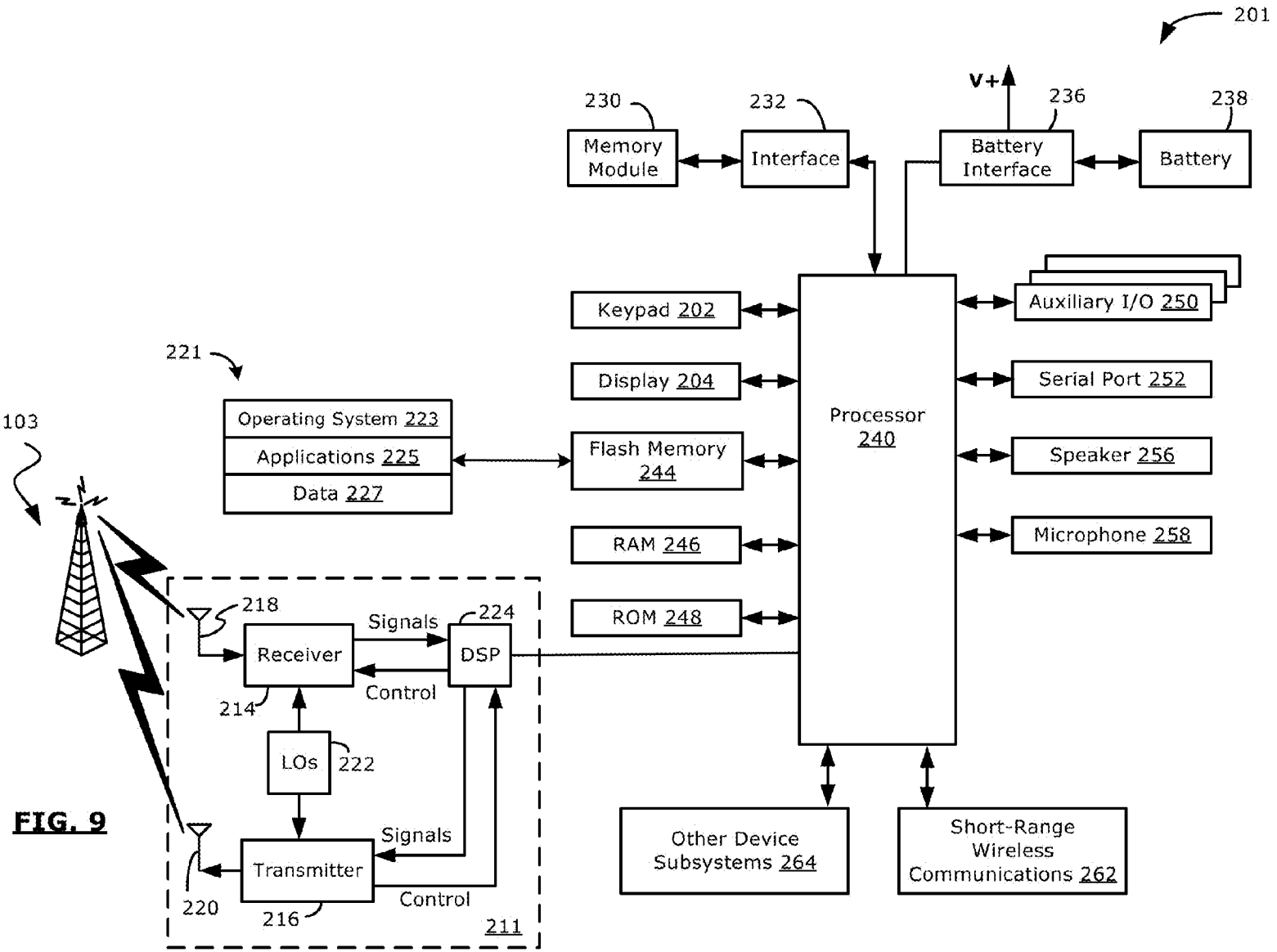
FIG. 9 is a block diagram illustrating a handheld electronic device in accordance with one example embodiment of the present disclosure.

Reference is first made to FIGS. 1 to 3 which illustrate a key assembly 102 for use in an electronic device in accordance with one embodiment of the present disclosure. The key assembly 102 comprises a single-piece keycap 104 having a plurality of hard key portions 106 separated by mechanically deforming portions 108, a key subassembly 120, and a dome sheet 130 comprising a plurality of dome switches 132. In other embodiments, the dome sheet 130 may be considered part of the host electronic device such as a handheld electronic device 201 (FIG. 9).

The key subassembly 120 comprises a hard frame (126, 128) formed of a rigid plastic and a flexible member (122, 124) formed of soft rubber. In at least some embodiments, the hard frame (126,128) is formed of a rigid polycarbonate using injection molding (which is polycarbonate L1225L in some embodiments) and the flexible member (122, 124) is formed from silicone rubber 60, Shore A using compression molding. Similarly, in at least some embodiments, the keycap 104 is formed of a rigid polycarbonate using injection molding (which is polycarbonate L1225L in some embodiments). In the shown embodiment, the hard frame (126,128) is comolded with the flexible member (122, 124).

In some embodiments, each dome switch 132 comprises a polyethylene terephthalate (PET) film which overlays a collapsible metal dome having a nickel plating over a gold plating on a flexible printed circuit board (PCB). When a key portion 106 is pressed, the dome of the respective dome switch collapses thereby connecting the conductive platings and completing a connection therebetween. The controller of the host electronic device receives an input signal in response to the connection of the conductive platings caused by actuation of the dome switch. The controller recognizes a corresponding input in response to the received input signal, which could be a character input or other input. In other embodiments, other dome switch constructions could be used.

The key subassembly 120 comprises a flexible member having opposed first and second sides represented by references 125 and 127. The flexible member has a plurality of key stem protrusions 122 on the first side 125 for attaching the flexible member to the plurality of key portions 106 of the keycap 104. The key stem protrusions 122 are sometimes referred to as key gluing stems, and are attached to the plurality of key portions 106 on an opposed internally facing side 107 of the keycap 104 using a suitable adhesive. The flexible member also has a plurality of actuators 124 on the second side 127 for actuating the dome switches 132 of the dome sheet 130.

The key subassembly 120 also includes a stiffening member 128 which surrounds at least a portion of each of the plurality of key stem protrusions 122. The stiffening member 128 may be formed of metal or rigid plastic (i.e., a hard plastic or inflexible plastic) in some embodiments. The stiffening member 128 includes or has attached thereto support pins 126 extending away from the keycap 104 for supporting the key assembly 102 and attaching it to the housing (not shown) of the host electronic device. The pins 126 are typically heat stake pins but could be alignment pins. The stiffening member 128 supports the key assembly 102 and prevents it from bowing out of the housing of the host electronic device or deforming the key assembly 102 while allowing local flexing and deformation of the flexible member and key portions 106 of the key cap 104. In the shown embodiment, the stiffening member 128 is disposed between the keycap 104 and the flexible member and surrounds the entirety of each of the plurality of key stem protrusions 122. In other embodiments, the stiffening member 128 could be comolded with the flexible member, or disposed below the flexible member provided it is proper adhered to the bottom of the flexible member at the location of the support pins 126.

Figure 8:
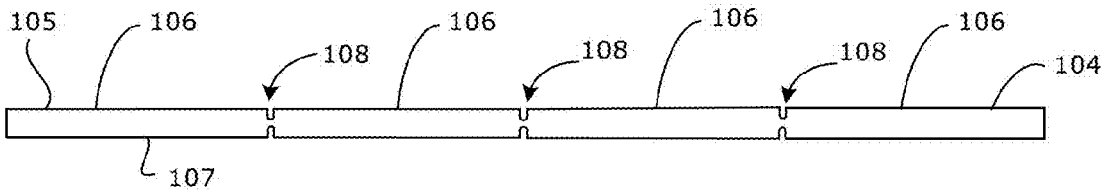
FIG. 8 is a sectional view of a keycap in accordance with an alternate embodiment of the present disclosure.

In some embodiments, the mechanically deforming portions 108 of the keycap 104 are thinner than the key portions 106 of the keycap 104. In such embodiments, the mechanically deforming portions 108 may be defined by grooves in the keycap as shown, for example, in FIGS. 1 to 3. In some embodiments, the grooves may be formed on one side of the keycap 104 as shown, for example, in FIGS. 1 to 3. In other embodiments, the grooves may be formed on opposed sides of the keycap 104 as shown in FIG. 8. In some embodiments, the mechanically deforming portions 108 are approximately 0.25 mm in thickness. While the mechanically deforming portions 108 may have a thickness which is relatively constant in some embodiments, the thickness of the keycap 104 may vary in other portions of the keycap 104 such as across and/or between the key portions 106. While an example thickness of the mechanically deforming portions 108 of some embodiments has been described, the thickness of the mechanically deforming portions 108 may vary between different embodiments, typically as a function of the material from which the keycap 104 is constructed, the overall thickness of the keycap 104, or both.

In some embodiments, the grooves may be provided on an externally facing side 105 of the keycap 104 to provide the dual functions of mechanical deformation to allow for key presses of the respective key portions 106 of the keycap 104, and visual separation between key portions 106 of the keycap 104 for key identification by device users. In other embodiments, the grooves may be provided on the internally facing side 105 of the keycap 104 to provide mechanical deformation to allow for key presses of the respective key portions 106 of the keycap 104. However, visual indications of the individual key portions 106 of the keycap 104 are provided by other means.

In other embodiments, the mechanically deforming portions 108 could be comprised of a flexible material and the key portions 106 are comprised of a rigid material. In some embodiments, the mechanically deforming portions 108 may be formed of a flexible rubber and the key portions 106 formed of a rigid plastic such as polycarbonate. The mechanically deforming portions 108 could be formed of a flexible rubber comolded with a rigid plastic which forms the key portions 106.

In the shown embodiment of FIGS. 1 to 3, each key portion 106 is separated by respective mechanically deforming portions 108, however in other embodiments more than one key portion 106 may be defined by respective mechanically deforming portions 108. For example, a pair of spaced apart mechanically deforming portions 108 may define a two-key pair having a toggle key construction as in the key assembly 402 of FIG. 4.

Referring to FIGS. 4 to 7, a key assembly 402 for use in an electronic device in accordance with another embodiment of the present disclosure will be described. As will be described in more detail below, the key assembly 402 is similar to the key assembly 102 in many respects with notable differences being that the key assembly 402 provides backlighting of its key portions, circuitry for actuating the domes, and structural elements for mounting/attaching the key assembly 402 to the host electronic device. The key assembly 402 of FIGS. 4 to 7 is used in the construction of a control key panel or keypad of front face of a handheld electronic device such as a smartphone. The key portions represent a phone call key, a menu key, escape (ESC) key, and an end phone key.

The key assembly 402 comprises a single-piece keycap 404 having a plurality of key portions 406 separated by mechanically deforming portions 408, a light guide subassembly 410, a dome sheet 430 comprising domes switches 432, a flexible PCB 440 including light emitting diodes (LEDs) 442, and a mounting subassembly 450 for mounting the key assembly 402 to the host electronic device, for example, the handheld electronic device 201 described below. At least some of the key portions 406 have a transparent portion or window 460 (FIG. 7) for transmitting light therethrough. In the shown embodiment, each of the key portions 406 have a transparent portion 460 for transmitting light therethrough to provide backlighting of the key portions 406. In at least some embodiments, the keycap 404 is formed of a rigid polycarbonate. The key portions 406 and mechanically deforming portions 408 of the keycap 404 are formed in a manner similar to the keycap 104 described above. However, the keycap 404 includes only 2 mechanically deforming portions 408.

In some embodiments, the keycap 404 is formed of a transparent material such as a light diffusing polycarbonate which is painted with a desired colour or colours and laser-etched to remove a portion of the paint and expose the transparent material for transmitting light therethrough. In some embodiments, the key portions 406 are painted a first colour which will provide the backlight colour and then painted a second colour which, for example, matches a colour of the housing of the host electronic device 201. The second colour is then laser-etched in predefined shapes to expose the first colour. The predefined shape may be used to provide a visual representation will informs the device user of a function of the respective key portions 406. The predefined shape is typically different for each key portion 406. The first colour may vary between key portions 406. When assembled into the host electronic device 201, activation of the LEDs backlights the respective key portions 406 so as to illuminate the laser-etched shape in the respective background colour (e.g., the first colour).

Figure 4:
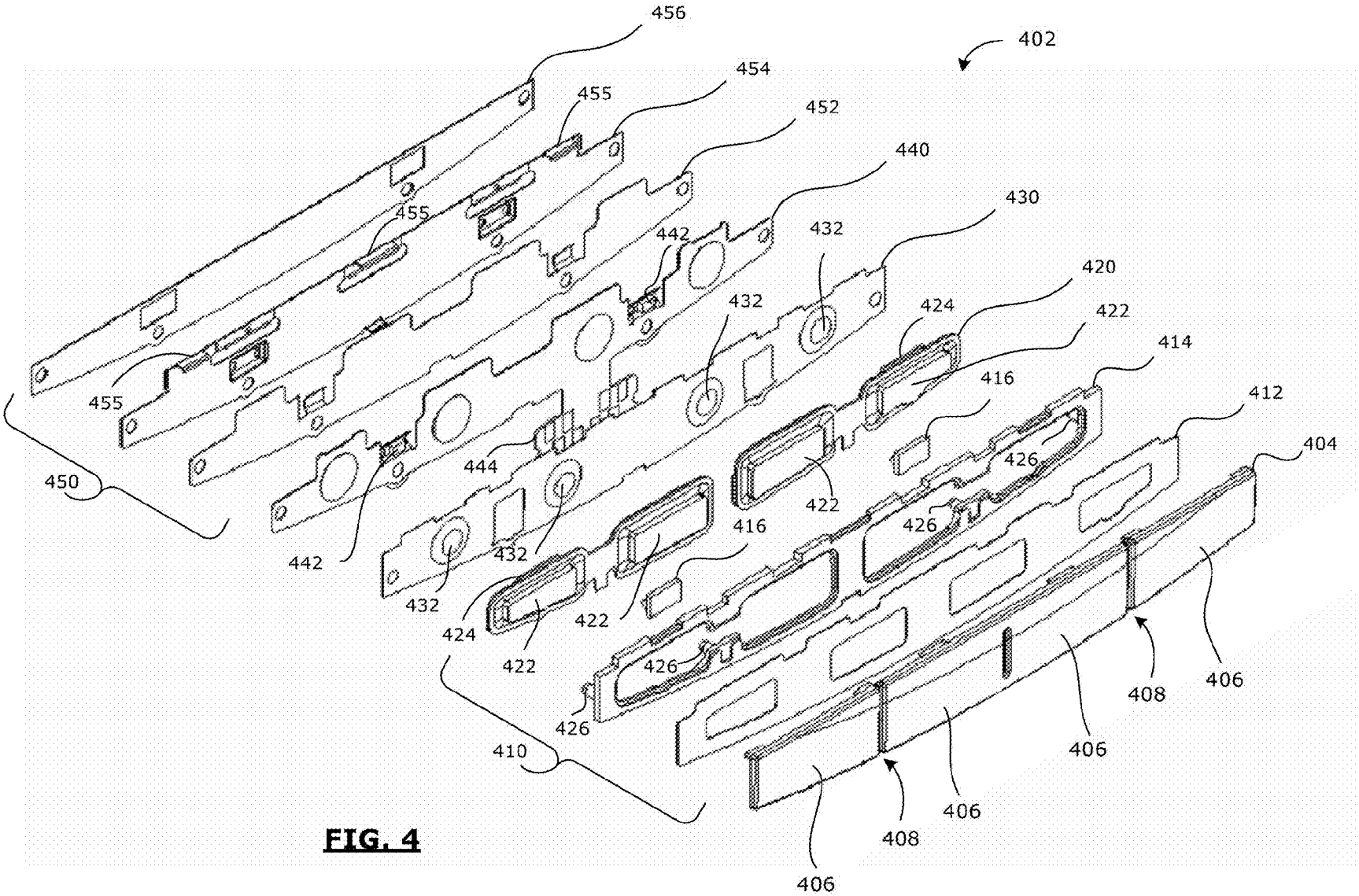
FIG. 4 is an exploded perspective view of a key assembly in accordance with another example embodiment of the present disclosure.
Figure 5:
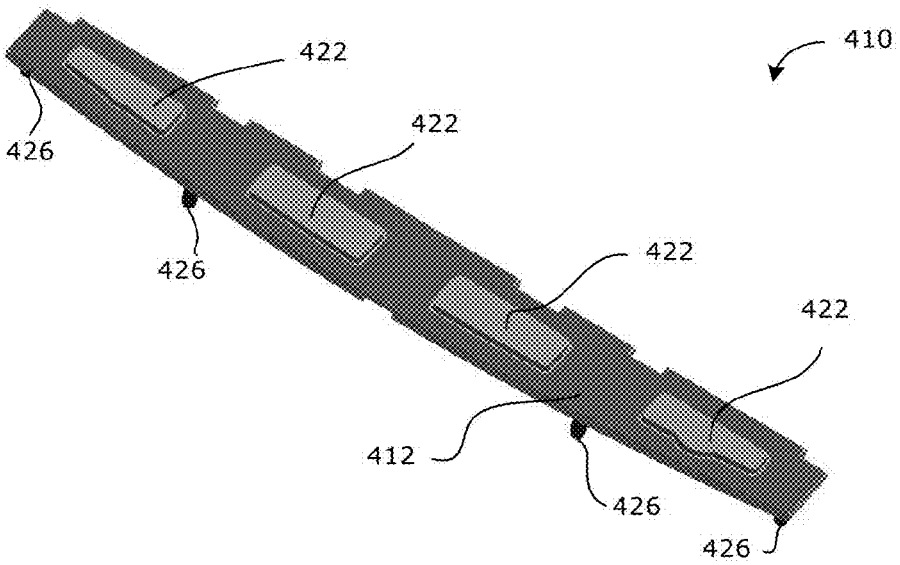
FIG. 5 is a perspective view of a light guide subassembly for the key assembly of FIG. 4.
Figure 6:
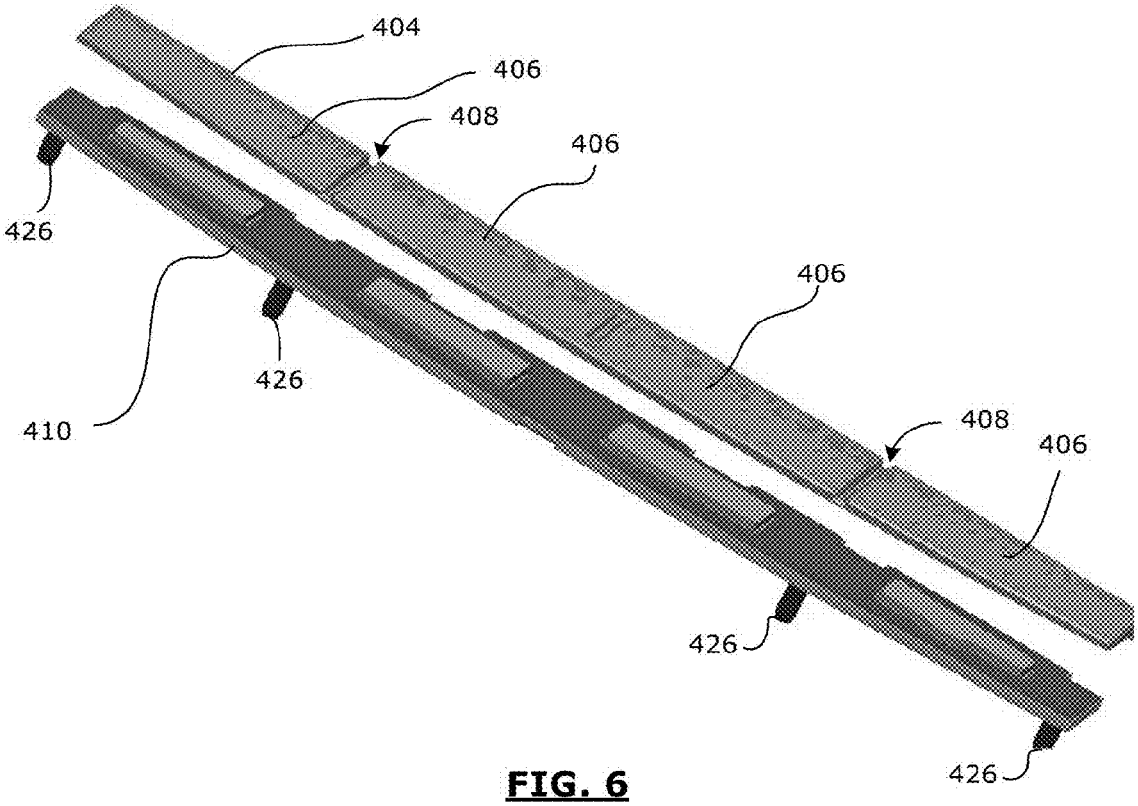
FIG. 6 is a perspective view of the light guide subassembly of FIG. 5 with a keycap.

The light guide subassembly 410, shown in greater detail in FIGS. 4 and 5, comprises an opaque light blocking sheet 412, a stiffening member 414, a pair of transparent members 416 formed of a light diffusing material such as a light diffusing polycarbonate, and a pair of flexible members 420 each comprising a pair of key stem protrusions 422 on a first side thereof and a pair of actuators 424 (only one actuator 424 in each pair being shown in FIG. 4) on a second side of the flexible members 420 opposite the first side. In other embodiments, a single flexible member rather than a pair of flexible members 420 could be used. The flexible members 420 are formed of a transparent material for transmitting light therethrough. The transparent material from which the flexible members 420 are formed is also a resilient deformable material which, in some embodiments, is a transparent silicon rubber 60, Shore A using compression molding.

The stiffening member 414 is formed of an opaque light blocking to provide light blocking as well as stiffening of the key assembly 402. The stiffening member 414 also includes or has attached thereto support pins 426 extending away from the keycap 404 for supporting the key assembly 402 and attaching the key assembly 402 to the housing (not shown) of the host electronic device along with the mounting subassembly 450. The pins 426 are typically heat stake pins but could be alignment pins.

In some embodiments, the light blocking sheet 412 is a black or other opaque paper sheet. In some embodiments, the stiffening member 414 is formed of a black polycarbonate and the transparent members 416 are a clear light diffusing polycarbonate. In some embodiments, the stiffening member 414 and transparent members 416 may be comolded using a two-shot injection molding process in which the stiffening member 414 is formed from a black polycarbonate in the first shot and the transparent members 416 are formed from a clear light diffusing polycarbonate in the second shot. In other embodiments, the stiffening member 414 could be shaped or otherwise configured to perform all of the light blocking obviating the need for the light blocking sheet 412. In yet other embodiments, the light blocking sheet 412 could be shaped or otherwise configured to perform all of the light blocking so that the stiffening member 414 need not be formed from a light blocking material in which case the stiffening member 414 and transparent members 416 could be one piece.

In the shown embodiments the light blocking material surrounds the entirety of the key stem projections 422; however, in other embodiments the light blocking material need only surround the periphery of the light guide assembly 410 in a manner that light is blocked from escaping from the periphery of the keycap 404.

The flexible PCB 440 includes a pair of LEDs 442 positioned adjacent to the second side of the flexible members 420 and the actuators 424 are located for illuminating adjacent key portions 406 having a transparent portion and the via the corresponding key stem protrusions 422 and transparent members 416 when the LEDs 442 are activated. The transparent members 416 are located directly above the LEDs 442 and, in combination with the key stem protrusions 422 and actuators 424, provide the light transmissive materials of the light guide allowing the transmission of light out through the transparent portions 460 of the keycap 404. The light blocking sheet 412 and stiffening member 414 provide the blocking transmissive materials of the light guide and prevent light from escaping around the outer boundary of the keycap 404 when assembled in the host electronic device 201. The LEDs 442 are positioned to avoid interference with the plurality of actuators 424 when the dome switches 432 are actuated. In the shown embodiment, the LEDs 442 are positioned adjacent to the dome switches 432. The flexible PCB 440 also includes contacts connected to the dome switches 432 of the dome switch sheet 430 and a communication interface 444 for connecting to a communication interface of the PCB of the host electronic device for communicating with its controller 244 (FIG. 9).

The mounting subassembly 450 comprises a first double-sided adhesive layer 452, a secondary stiffener 454 having three clips 455 for attaching the key assembly 402, and a second double-sided adhesive layer 456 for mounting the key assembly 402 to the host electronic device. The secondary stiffener 454 provides support for the PCB 440. The first double sided adhesive 452 layer adheres the PCB 440 to the secondary stiffener 454. The secondary stiffener 454 is formed of metal or rigid plastic and provides additional stiffening of the key assembly 402. The PCB 440 and the layers 452, 454 and 456 of the mounting subassembly 450 each define a plurality of holes which are arranged within each layer and aligned between layers for allowing the heat stake pins 426 to extend therethrough. The heat stake pins 426, clips 455 on the secondary stiffener 454, and the second double-sided adhesive layer 456 attach the key assembly 402 to the device housing. In other embodiments, if the dome sheet 430 and PCB 440 are omitted because a primary dome sheet and PCB of the host electronic device are being used, the mounting assembly 450 could be omitted.

Figure 7:
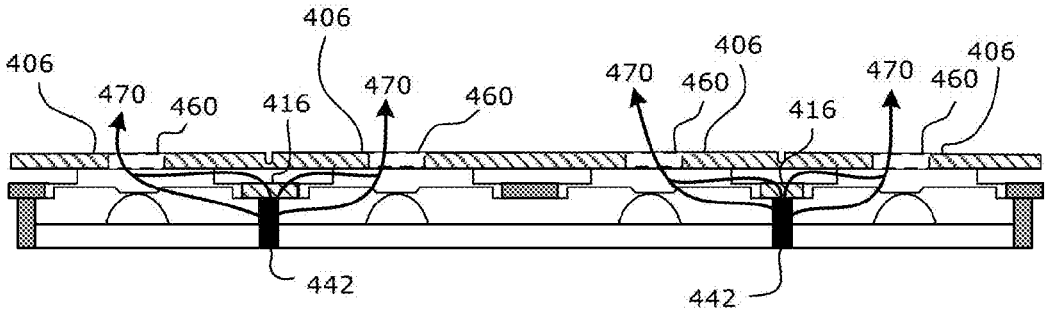
FIG. 7 is a schematic diagram of the main portions of the key assembly of FIG. 4 showing the path of light through the light guide subassembly.

Referring to FIG. 7, the path of light 470 through the light guide subassembly 410 will now be briefly discussed. The key assembly 402, using the light guide subassembly 410, creates a path of light 470 from the LEDs 442 of the PCB layer 440, through the transparent members 416 and 420, and through the transparent portions 460 of the key portions 406 of the keycap 404 to illuminate the predefined shapes of the transparent portions 460. The light emitted from the LEDs 442 first passes into the transparent members 416 of the light guide subassembly 410. The light blocking materials of the light guide subassembly 410 direct the light outwardly towards the transparent flexible members 420 and block the light from escaping from the periphery of the keycap 404. Next, the light passes from the transparent flexible members 420 through the transparent portions 460 in the adjacent key portions 406 of the key cap 404.

In the key assembly 402, the light guide subassembly 410 provides the dual functions of a light guide and a stiffener. However, in other embodiments a stiffening member without light guiding could be used instead of the light guide subassembly 410. In such embodiments, the stiffening member is similar to the stiffening member 128 described above in connection with FIGS. 1 to 3 and surrounds at least a portion of each of the plurality of key stem protrusions 422 which are attached to the plurality of key portions 406. Typically, the stiffening member surrounds the entirety of each of the plurality of key stem protrusions 422. The stiffening member 128 may be formed of metal or rigid plastic (i.e., a hard plastic or inflexible plastic) in some embodiments. The stiffening member could take the shape of the light blocking sheet 412 or the stiffening member 414 of the light guide subassembly 410 shown in FIG. 4. The stiffening member includes or has attached thereto the support pins 426. The stiffening member supports the key assembly 402 and prevents it from bowing out of the housing of the host electronic device or deforming the key assembly 402 while allowing local flexing and deformation of the flexible member and key portions 406 of the key cap 404. The stiffening member could surround the entirety of each of the plurality of key stem protrusions 422, and could be disposed between the keycap 404 and the flexible members 420, comolded with the flexible members 420, or disposed below the flexible members 420 provided it is proper adhered to the bottom of the flexible members 420 at the location of the support pins 426.

While portions of the key assemblies 102 and 402 are shown as separate elements, some of these elements may be combined in other embodiments or formed together using comolding in other embodiments. It is also possible that some of the elements described a single element may be implemented using multiple elements in other embodiments.

While the key portions 106 and 406 of the key assemblies 102 and 402 are substantially similar in size and shape, in other embodiments the key portions 106 and 406 may differ in size, shape, or both. Moreover, while one dome switch is provided for every key portion 106, 406 in the keycaps 104, 404 of the shown embodiments, more or less than one dome switch could be used per key portion 106, 406 in other embodiments.

While the key assembly 402 of FIGS. 4 to 7 is used in the construction of a control key panel or keypad of a handheld electronic device, in other embodiments the keypad may be located elsewhere, may be used for other functions, and may have a different number of keys. For example, the key assembly 402 may utilize a primary dome switch sheet and circuitry of the handheld electronic device which, for example, may be used by a keyboard of the handheld electronic device. Moreover, while the key assemblies 102 and 402 are shown as being a row of keys, it will be appreciated that the teachings of the present disclosure may be applied to the construction of any two or more adjacent keys, such as a row of keys, a column of keys, or a two-dimensional arrangement of keys. Moreover, the teachings of the present disclosure may be applied in the construction of control keys in a control panel of an electronic device such as a handheld electronic device, a keypad such as a standard numeric keypad, or a full keyboard (which could be configured in a familiar QWERTY, QWERTZ, AZERTY, or Dvorak layout known in the art).

Reference is now made to FIG. 9 which illustrates a handheld electronic device 201 in which example embodiments described in the present disclosure can be applied. The handheld electronic device 201 is a two-way communication device having data and voice communication capabilities, and the capability to communicate with other computer systems, for example, via the Internet. However, the handheld electronic device 201 Depending on the functionality provided by the handheld electronic device 201, in various embodiments the device 201 may be a multiple-mode communication device configured for both data and voice communication, a smartphone, a mobile telephone or a PDA (personal digital assistant) enabled for wireless communication, or a computer system with a wireless modem.

The handheld electronic device 201 includes a rigid case (not shown) housing the components of the device 201. The internal components of the device 201 are constructed on, or connected via, a printed circuit board (PCB). The handheld electronic device 201 includes a controller comprising at least one processor 240 (such as a microprocessor) which controls the overall operation of the device 201. The processor 240 interacts with device subsystems such as a wireless communication subsystem 211 for exchanging radio frequency signals with the wireless network 203 to perform communication functions. The processor 240 interacts with additional device subsystems including a display (screen) 204 such as a liquid crystal display (LCD) screen, a keypad 202 constructed using a key assembly in accordance with the present disclosure such as the key assembly 102 of FIG. 1 or the key assembly 402 of FIG. 4, possibly other input devices (not shown), flash memory 244, random access memory (RAM) 246, read only memory (ROM) 248, auxiliary input/output (I/O) subsystems 250, data port 252 such as serial data port, such as a Universal Serial Bus (USB) data port, speaker 256, microphone 258, short-range communication subsystem 262, and other device subsystems generally designated as 264. Some of the subsystems shown in FIG. 9 perform communication-related functions, whereas other subsystems may provide "resident" or on-device functions. In other embodiments, instead of the keypad 202, the handheld electronic device 201 may comprise a keyboard constructed using a key assembly in accordance with the present disclosure such as the key assembly 102 of FIG. 1 or the key assembly 402 of FIG. 4.

The device 201 may comprise a touchscreen display in some embodiments. The touchscreen display may be constructed using a touch-sensitive input side connected to an electronic controller and which overlays the display screen 204. The touch-sensitive overlay and the electronic controller provide a touch-sensitive input device and the processor 240 interacts with the touch-sensitive overlay via the electronic controller.

The communication subsystem 211 includes a receiver 214, a transmitter 216, and associated components, such as one or more antenna elements 218 and 220, local oscillators (LOs) 222, and a processing module such as a digital signal processor (DSP) 224. The antenna elements 218 and 220 may be embedded or internal to the handheld electronic device 201 and a single antenna may be shared by both receiver and transmitter, as is known in the art. As will be apparent to those skilled in the field of communication, the particular design of the wireless communication subsystem 211 depends on the wireless network 203 in which handheld electronic device 201 is intended to operate.

The handheld electronic device 201 may communicate with any one of a plurality of fixed transceiver base stations 108 of the wireless network 203 within its geographic coverage area. The handheld electronic device 201 may send and receive communication signals over the wireless network 203 after the required network registration or activation procedures have been completed. Signals received by the antenna 218 through the wireless network 203 are input to the receiver 214, which may perform such common receiver functions as signal amplification, frequency down conversion, filtering, channel selection, etc., as well as analog-to-digital (A/D) conversion. A/D conversion of a received signal allows more complex communication functions such as demodulation and decoding to be performed in the DSP 224. In a similar manner, signals to be transmitted are processed, including modulation and encoding, for example, by the DSP 224. These DSP-processed signals are input to the transmitter 216 for digital-to-analog (D/A) conversion, frequency up conversion, filtering, amplification, and transmission to the wireless network 203 via the antenna 220. The DSP 224 not only processes communication signals, but may also provide for receiver and transmitter control. For example, the gains applied to communication signals in the receiver 214 and the transmitter 216 may be adaptively controlled through automatic gain control algorithms implemented in the DSP 224.

The processor 240 operates under stored program control and executes software modules 221 stored in memory such as persistent memory, for example, in the flash memory 244. As illustrated in FIG. 9, the software modules 221 comprise operating system software 223 and software applications 225. Those skilled in the art will appreciate that the software modules 221 or parts thereof may be temporarily loaded into volatile memory such as the RAM 246. The RAM 246 is used for storing runtime data variables and other types of data or information, as will be apparent to those skilled in the art. Although specific functions are described for various types of memory, this is merely one example, and those skilled in the art will appreciate that a different assignment of functions to types of memory could also be used.

In some embodiments, the handheld electronic device 201 also includes a removable memory card 230 (typically comprising flash memory) and a memory card interface 232. Network access typically associated with a subscriber or user of the handheld electronic device 201 via the memory card 230, which may be a Subscriber Identity Module (SIM) card for use in a GSM network or other type of memory card for use in the relevant wireless network type. The memory card 230 is inserted in or connected to the memory card interface 232 of the handheld electronic device 201 in order to operate in conjunction with the wireless network 203.

The handheld electronic device 201 stores data 227 in an erasable persistent memory, which in one example embodiment is the flash memory 244. In various embodiments, the data 227 includes service data comprising information required by the handheld electronic device 201 to establish and maintain communication with the wireless network 203. The data 227 may also include user application data such as email messages, address book and contact information, calendar and schedule information, notepad documents, image files, and other commonly stored user information stored on the handheld electronic device 201 by its user, and other data. The data 227 stored in the persistent memory (e.g. flash memory 244) of the handheld electronic device 201 may be organized, at least partially, into a number of databases each containing data items of the same data type or associated with the same application. For example, email messages, contact records, and task items may be stored in individual databases within the device memory.

The serial data port 252 may be used for synchronization with a user's host computer system (not shown). The serial data port 252 enables a user to set preferences through an external device or software application and extends the capabilities of the handheld electronic device 201 by providing for information or software downloads to the handheld electronic device 201 other than through the wireless network 203. The alternate download path may, for example, be used to load an encryption key onto the handheld electronic device 201 through a direct, reliable and trusted connection to thereby provide secure device communication.

In some embodiments, the handheld electronic device 201 is provided with a service routing application programming interface (API) which provides an application with the ability to route traffic through a serial data (i.e., USB) or Bluetooth® (Bluetooth® is a registered trademark of Bluetooth SIG, Inc.) connection to the host computer system using standard connectivity protocols. When a user connects their handheld electronic device 201 to the host computer system via a USB cable or Bluetooth® connection, traffic that was destined for the wireless network 203 is automatically routed to the handheld electronic device 201 using the USB cable or Bluetooth® connection. Similarly, any traffic destined for the wireless network 203 is automatically sent over the USB cable Bluetooth® connection to the host computer system for processing.

The handheld electronic device 201 also includes a battery 238 as a power source, which is typically one or more rechargeable batteries that may be charged, for example, through charging circuitry coupled to a battery interface such as the serial data port 252. The battery 238 provides electrical power to at least some of the electrical circuitry in the handheld electronic device 201, and the battery interface 236 provides a mechanical and electrical connection for the battery 238. The battery interface 236 is coupled to a regulator (not shown) which provides power V+ to the circuitry of the handheld electronic device 201.

The short-range communication subsystem 262 is an additional optional component which provides for communication between the handheld electronic device 201 and different systems or devices, which need not necessarily be similar devices. For example, the subsystem 262 may include an infrared device and associated circuits and components, or a wireless bus protocol compliant communication mechanism such as a Bluetooth® communication module to provide for communication with similarly-enabled systems and devices.

A predetermined set of applications that control basic device operations, including data and possibly voice communication applications will normally be installed on the handheld electronic device 201 during or after manufacture. Additional applications and/or upgrades to the operating system 221 or software applications 225 may also be loaded onto the handheld electronic device 201 through the wireless network 203, the auxiliary I/O subsystem 250, the serial port 252, the short-range communication subsystem 262, or other suitable subsystem 264. The downloaded programs or code modules may be permanently installed, for example, written into the program memory (i.e. the flash memory 244), or written into and executed from the RAM 246 for execution by the processor 240 at runtime. Such flexibility in application installation increases the functionality of the handheld electronic device 201 and may provide enhanced on-device functions, communication-related functions, or both. For example, secure communication applications may enable electronic commerce functions and other such financial transactions to be performed using the handheld electronic device 201.

The handheld electronic device 201 may provide two principal modes of communication: a data communication mode and an optional voice communication mode. In the data communication mode, a received data signal such as a text message, an email message, or Web page download will be processed by the communication subsystem 211 and input to the processor 240 for further processing. For example, a downloaded Web page may be further processed by a browser application or an email message may be processed by the email message messaging application 272 and output to the display 204. A user of the handheld electronic device 201 may also compose data items, such as email messages, for example, using the input devices in conjunction with the display screen 204. These composed items may be transmitted through the communication subsystem 211 over the wireless network 203.

In the voice communication mode, the handheld electronic device 201 provides telephony functions and operates as a typical cellular phone. The overall operation is similar, except that the received signals would be output to the speaker 256 and signals for transmission would be generated by a transducer such as the microphone 258. The telephony functions are provided by a combination of software/firmware (i.e., the voice communication module) and hardware (i.e., the microphone 258, the speaker 256 and input devices). Alternative voice or audio I/O subsystems, such as a voice message recording subsystem, may also be implemented on the handheld electronic device 201. Although voice or audio signal output is typically accomplished primarily through the speaker 256, the display screen 204 may also be used to provide an indication of the identity of a calling party, duration of a voice call, or other voice call related information.

The various embodiments presented above are merely examples and are in no way meant to limit the scope of this disclosure. Variations of the innovations described herein will be apparent to persons of ordinary skill in the art, such variations being within the intended scope of the present application. In particular, features from one or more of the above-described embodiments may be selected to create alternative embodiments comprised of a sub-combination of features which may not be explicitly described above. In addition, features from one or more of the above-described embodiments may be selected and combined to create alternative embodiments comprised of a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A key assembly for use in an electronic device, comprising:

a one-piece keycap having a plurality of rigid key portions separated by mechanically deforming portions provided by at least one groove on the one-piece keycap;

a flexible member having opposed first and second sides, the first side having a plurality of key stems which are attached to the plurality of key portions, the second side having a plurality of actuators for actuating dome switches of the electronic device; and a stiffening member surrounding at least a portion of each of the plurality of key stems and having a plurality of support pins extending away from the one-piece keycap for supporting the key assembly and attaching the key assembly to a housing of the electronic device, the stiffening member being aligned with the at least one groove on the one-piece keycap.

2. The key assembly of claim 1, wherein the mechanically deforming portions are thinner than the key portions of the one-piece keycap.

3. The key assembly of claim 2, wherein the mechanically deforming portions are approximately 0.25 mm in thickness.

4. The key assembly of claim 1, wherein the key portions have an externally facing side and an opposed internally facing side attached to the plurality of key stems of the flexible member, wherein the at least one groove is provided on the externally facing side to provide a visual separation of the key portions.

5. The key assembly of claim 1, wherein the at least one groove is provided on opposed sides of the one-piece keycap.

6. The key assembly of claim 1, wherein the mechanically deforming portions are comprised of a flexible material and the key portions are comprised of a rigid material.

7. The key assembly of claim 6, wherein the mechanically deforming portions are formed of a flexible rubber and the key portions are formed of a rigid plastic.

8. The key assembly of claim 7, wherein the mechanically deforming portions are formed of a flexible rubber comolded with a rigid plastic material which forms the key portions.

9. The key assembly of claim 1, wherein at least some of the key portions have a transparent portion, the corresponding key stems attached to the at least some of the key portions having a transparent portion being formed of a transparent material, the key assembly further comprising light emitting diodes (LEDs) positioned adjacent to the second side of the flexible member having the plurality of actuators for illuminating the at least some of the key portions having a transparent portion and the corresponding key stems when the LEDs are activated.

10. The key assembly of claim 9, wherein the LEDs are positioned to avoid interference with the plurality of actuators when the dome switches are actuated.

11. The key assembly of claim 10, wherein the LEDs are positioned adjacent to at least some of the dome switches.

12. An electronic device, comprising:

a controller for controlling the operation of the device;

a dome sheet connected to the controller comprising a plurality of dome switches connected to the controller for generating an input signal in response to actuation thereof; and a key assembly comprising:

a one-piece keycap having a plurality of rigid key portions separated by mechanically deforming portions provided by at least one groove in the one-piece keycap;

a flexible member having opposed first and second sides, the first side having a plurality of key stems which are attached to the plurality of key portions, the second side having a plurality of actuators for actuating the dome switches; and a stiffening member surrounding at least a portion of each of the plurality of key stems and having a plurality of support pins extending away from the one-piece keycap for supporting the key assembly and attaching the key assembly to a housing of the electronic device, the stiffening member being aligned with the at least one groove on the one-piece keycap;

the controller being configured for receiving input signals in response to the actuation of the dome switches and for recognizing corresponding inputs in response to the received input signals.

13. The electronic device of claim 12, wherein the mechanically deforming portions are thinner than the key portions of the one-piece keycap.

14. The electronic device of claim 13, wherein the mechanically deforming portions are approximately 0.25 mm in thickness.

15. The electronic device of claim 12, wherein the key portions have an externally facing side and an opposed internally facing side attached to the plurality of key stems of the flexible member, wherein the at least one groove is provided on the externally facing side to provide a visual separation of the key portions.

16. The electronic device of claim 12, wherein the at least one groove is provided on opposed sides of the one-piece keycap.

17. The electronic device of claim 12, wherein the mechanically deforming portions are formed of a flexible rubber and the key portions are formed of a rigid plastic.

18. The electronic device of claim 12, wherein at least some of the key portions have a transparent portion, the corresponding key stems attached to the at least some of the key portions having a transparent portion being formed of a transparent material, the key assembly further comprising light emitting diodes (LEDs) positioned adjacent to the second side of the flexible member having the plurality of actuators for illuminating the at least some of the key portions having a transparent portion and the corresponding key stems when the LEDs are activated.

19. The electronic device of claim 18, wherein the LEDs are positioned to avoid interference with the plurality of actuators when the dome switches are actuated.

20. The electronic device of claim 18, wherein the LEDs are positioned adjacent to at least some of the dome switches.

* * * * *